United States Patent [19]

Delvo

[11] 4,136,472

[45] Jan. 30, 1979

[54] READOUT CASSETTE

[76] Inventor: Bernd Delvo, No. 35, Bürgermeister-Lauck-Strasse, 6093 Flörsheim am Main, Fed. Rep. of Germany

[21] Appl. No.: 775,211

[22] Filed: Mar. 7, 1977

[30] Foreign Application Priority Data

Mar. 11, 1976 [DE] Fed. Rep. of Germany ..... 2610117

[51] Int. Cl.[2] ..... G09F 11/29

[52] U.S. Cl. ..... 40/471; 40/347; 40/518

[58] Field of Search ..... 40/31, 86 R, 86 A, 117, 40/471, 518, 385, 347

[56] References Cited

U.S. PATENT DOCUMENTS

| | | | |
|---|---|---|---|
| 1,578,039 | 3/1926 | Kelly | 40/31 |
| 1,992,944 | 3/1935 | Grudin | 40/86 R |
| 2,354,183 | 7/1944 | Crichton | 40/86 R |
| 2,764,826 | 10/1956 | Fulton et al. | 40/86 R |
| 3,174,241 | 3/1965 | Rohan | 40/31 X |
| 3,358,393 | 12/1967 | Lewis | 40/31 |
| 3,364,604 | 1/1968 | Donaldson et al. | 40/31 |
| 3,983,651 | 10/1976 | Dickey | 40/31 |

FOREIGN PATENT DOCUMENTS

| | | | |
|---|---|---|---|
| 846316 | 6/1952 | Fed. Rep. of Germany | 40/86 R |
| 805251 | 8/1936 | France | 40/86 R |

*Primary Examiner*—John F. Pitrelli
*Attorney, Agent, or Firm*—John C. Smith, Jr.

[57] ABSTRACT

A readout cassette comprises a preferably two-part plastic casing in which two coil shafts are rotatably mounted. The coil shafts serve to receive a thin paper web or the like printed on at least one side. The web is unwrappable manually by means of a rotary knob or through the intermediary of an electric drive from one coil shaft to the other and vice versa in opposite directions behind two readout panels. The readout panels consist of a highly transparent plastic material and cover viewing apertures provided on the front and rear sides of the casing.

5 Claims, 6 Drawing Figures

READOUT CASSETTE

BACKGROUND OF THE INVENTION

This invention relates to a novel readout cassette, wherein a thin paper or film web unwrapping from upwardly to downwardly as well as in the opposite direction from downwardly to upwardly is printed on both sides and is capable of being read both from the front side and from the rear side by turning the readout cassette by means of two pellucid plastic panels. For instance on the front side of the readout cassette a first part of a consistent novel or the like may be read and on the rear side the conclusive text may be read. When thin paper is used, the total text corresponds to a book text of about 250 pages.

SUMMARY OF THE INVENTION

It is the object of the present invention to provide a readout cassette which allows a correlated text to read without having to insert a new paper or film web.

To attain this object the present invention provides a readout cassette which is characterized by a preferably two-part plastic casing in which two coil shafts to be driven separately are arranged which serve to receive a thin web of paper, plastic material or fabric printed on both sides which is capable of being unwrapped manually by means of one or two rotary knobs or through the intermediary of an electric drive from one coil shaft to the other and vice versa in opposite directions behind two pellucid plastic panels on the front and rear side of the casing.

The coil shafts may be arranged offset relative to one another in such a way that the periphery of a fully wrapped-up web defines a straight line with the second empty coil shaft. When the coil shafts are disposed in one plane, the web unwrappable in the one or the other direction is diverted through slot guides. When selectively using an electric drive, the drive box provided with the drive and switch members is applied laterally onto square shaft trunnions on the coil shafts by means of identically formed hollow drive shafts. Such a drive box is applicable for all readout cassettes.

BRIEF DESCRIPTION OF THE DRAWINGS

Two embodiments of the invention will now be described by way of example and with reference to the accompanying drawings, in which.

DESCRIPTION OF THE PREFERRED EMBODIMENTS

Figure 1A:
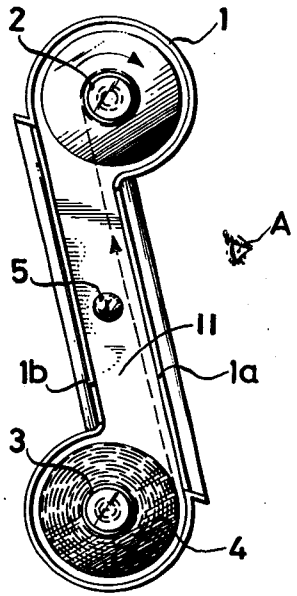
FIG. 1*a* is a side elevational view, partly in section, of the cassette with the upper coil shaft to be driven.
Figure 1:
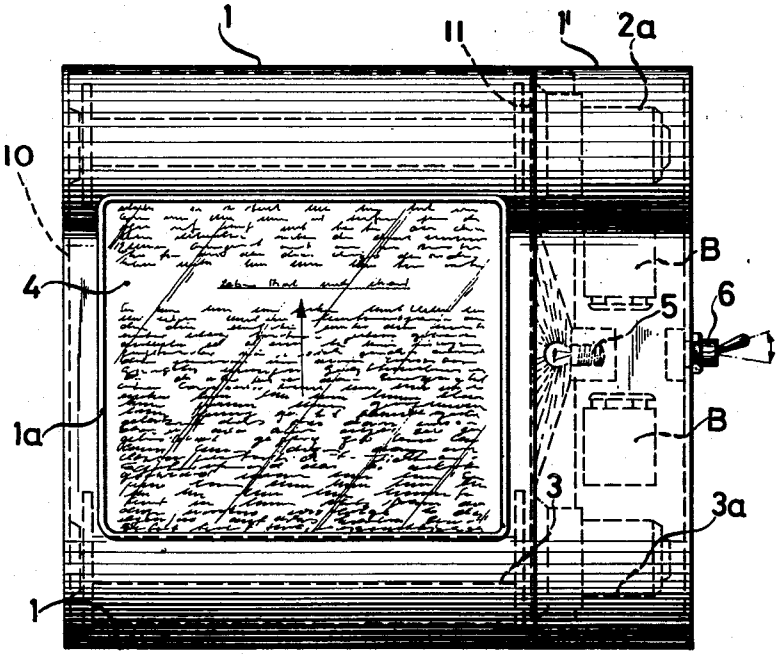
FIG. 1 is a front elevational view of a readout cassette according to the invention.
Figure 1B:
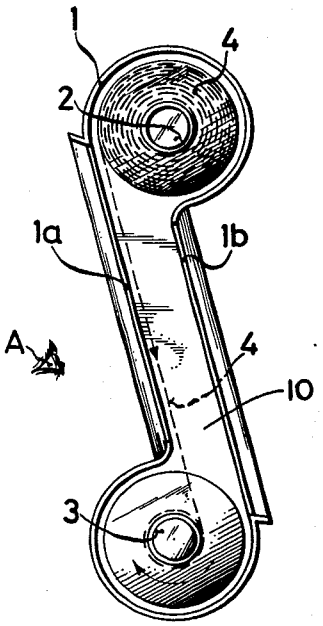
FIG. 1*b* is a similar view of the cassette with the lower coil shaft to be driven.

FIGS. 1, 1*a* and 1*b* show a first embodiment of the readout cassette according to the invention which comprises a cassette casing 1, an initially separate drive box $1^1$ laterally detachably attached to the cassette casing 1 and two readout panels 1*a* and 1*b*. The reference numerals 2 and 3 denote two coil shafts provided for receiving a web 4 made of paper, plastic material or fabric and printed on both sides, the coil shafts in this embodiment being arranged offset relative to one another and being rotatably supported at opposite ends respectively by end walls 10 and 11. In the drive box $1^1$ there are arranged electric drives 2*a* and 3*a*, two electric batteries B, a light source 5 and a toggle switch 6 which for instance in its upper position switches in the electric drive 2*a* and in its lower position switches in the electric drive 3*a*, while both electric drives are switched off in its central position. Interrupting contacts to be controlled by means of the web for instance may also be provided which stop the drive of the one or the other coil shaft when a new paragraph of the text to be read appears behind one of the readout panels.

Figure 2A:
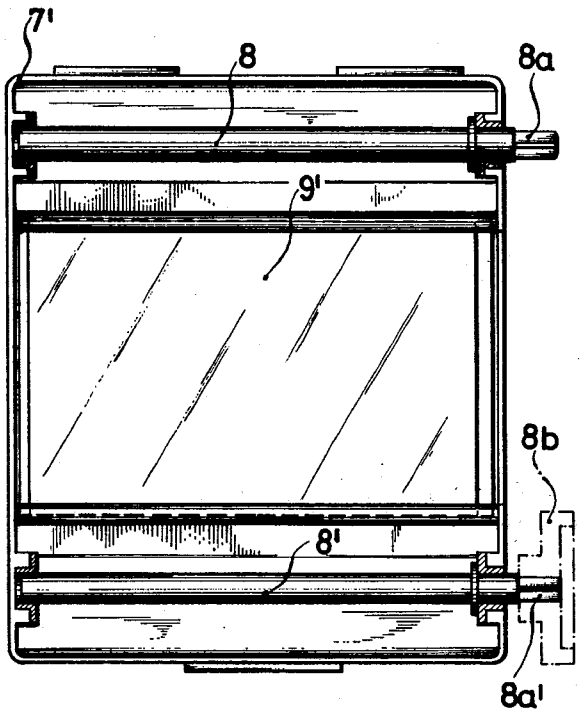
FIGS. 2 and 2*a* are interior views of the two casing halves of a readout cassette according to another embodiment.
Figure 3:
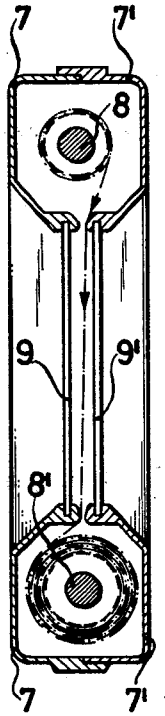
FIG. 3 is a cross section of the cassette of FIGS. 2 and 2*a*.
Figure 2:
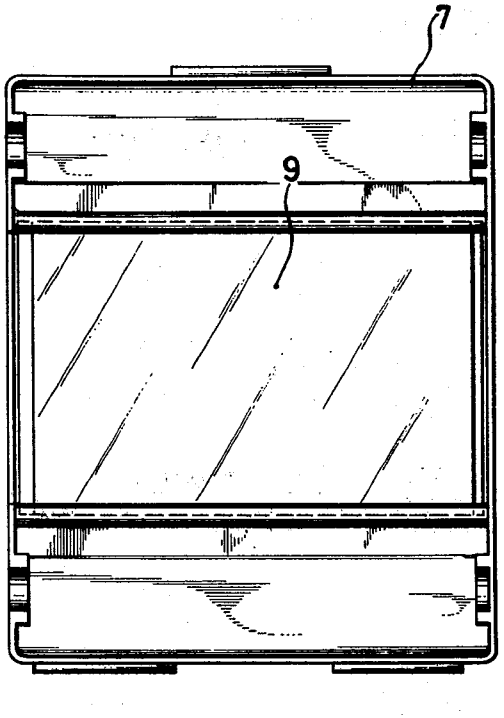

The second embodiment is shown in FIGS. 2*a*, 2*b* and 3. These figures show two casing halves 7 and $7^1$ with the coil shafts 8 and $8^1$ disposed in one plane and readout panels 9 and $9^1$. At 8*a* and $8a^1$ projecting square shaft trunnions of the coil shafts 8 and $8^1$ are provided for attaching the electric drive box $1^1$. The reference numeral 8*b* denotes a rotary knob for a manual manipulation, this rotary knob 8*b* being shown in dot and dash lines in FIG. 2*a*.

According to FIG. 3, the web is diverted through guide slots from the coil shaft 8 to the coil shaft $8^1$ and in opposite direction. The readout panels 9 and $9^1$ are preferably arrestable in the casing halves.

The invention may be embodied in other specific forms without departing from the spirit or essential characteristics thereof. The embodiments are therefore to be considered in all respects as illustrative and not restrictive.

I claim:

1. A readout cassette comprising:

a) a casing having front and back sides and comprising first and second chambers spaced from each other and first and second walls spaced and substantially parallel to each other and extending between said chambers, at least one of said walls having a viewing window therein;

b) first and second reels each having a core and mounted in said first and second chambers respectively for rotation about respective axes;

c) means extending from said casing for rotating at least one of said reels; and d) a thin elongated web having printing on at least one side thereof and extending between the cores of said reels, said web being coiled in one rotary direction about the core of one of said reels and being coiled in the opposite rotary direction about the core of the other of said reels;

e) said first and second walls extending from said first chamber tangentially on the front side of the axis of said first reel to said second chamber tangentially on the back side of the axis of said second reel such that the axis of said first reel is adjacent the back side of the plane of said first wall and is closer to the plane of said first wall than the plane of said second wall and the axis of said second reel is adjacent the front side of the plane of said second wall and is closer to the plane of said second wall than the plane of said first wall;

f) whereby said web extends in a straight line from said first reel and between said walls to said second reel during the period that said web is withdrawn from one of said reels and taken up on the other of said reels during simultaneous rotation of said reels in opposite directions.

2. A readout cassette according to claim 1, wherein the casing consists of two parts made of a plastic material.

3. A readout cassette according to claim 1, wherein the means for rotating said reels in opposite directions comprises at least one manually operable knob which is detachably attachable to square shaft trunnions projecting from the reels.

4. A readout cassette according to claim 1, wherein the means for rotating said reels in opposite directions comprises an electric drive and switching members, all arranged in a separate box which is laterally detachably attachable on the casing.

5. A readout cassette according to claim 1, wherein the web is made of a material selected from the group consisting of paper, plastic material and fabric.

* * * * *